US007354234B2

(12) United States Patent
Fujishige et al.

(10) Patent No.: US 7,354,234 B2
(45) Date of Patent: Apr. 8, 2008

(54) METHOD FOR MANUFACTURING CAN BODY PRINTED TO SHOULDER PORTION

(75) Inventors: Eiji Fujishige, Sagamihara (JP); Yasushi Enoki, Sagamihara (JP)

(73) Assignee: Daiwa Can Company, Tokyo (JP)

( * ) Notice: Subject to any disclaimer, the term of this patent is extended or adjusted under 35 U.S.C. 154(b) by 75 days.

(21) Appl. No.: 11/149,359

(22) Filed: Jun. 10, 2005

(65) Prior Publication Data

US 2006/0277957 A1 Dec. 14, 2006

(51) Int. Cl.
*B21D 51/26* (2006.01)
*B21B 45/00* (2006.01)

(52) U.S. Cl. ..... 413/2; 72/46; 72/379.4

(58) Field of Classification Search ..... 72/46, 72/379.4; 413/2, 4, 18; 283/117; 355/52
See application file for complete search history.

(56) References Cited

U.S. PATENT DOCUMENTS 2,359,775 A 10/1944 McManus et al.
3,238,909 A * 3/1966 Kendall ..... 72/379.4
3,766,851 A 10/1973 Sirvet et al.
3,924,437 A 12/1975 Hoertig
4,048,917 A 9/1977 Skrypek et al.
4,092,949 A 6/1978 Balordi
4,098,420 A 7/1978 Torii
4,192,166 A * 3/1980 Johnson ..... 72/347
4,256,233 A 3/1981 Harding
5,143,793 A * 9/1992 Masse et al. ..... 428/577
5,293,765 A 3/1994 Nussbaum-Pogacnik
5,355,710 A 10/1994 Diekhoff
5,704,240 A 1/1998 Jordan
5,718,352 A 2/1998 Diekhoff et al.
6,463,776 B1 10/2002 Enoki et al.
6,499,329 B1 12/2002 Enoki et al.
6,779,677 B2 8/2004 Chupak
6,857,304 B2 2/2005 Enoki

FOREIGN PATENT DOCUMENTS

JP 2000-191006 7/2000

* cited by examiner

*Primary Examiner*—Jimmy T. Nguyen
(74) *Attorney, Agent, or Firm*—Oblon, Spivak, McClelland, Maier & Neustadt, P.C.

(57) ABSTRACT

A can body manufacturing method, in which a bottomed cylindrical long cup is shaped from a metal material, in which a printed decoration is then applied to the outer face of a cylindrical trunk portion of the long cup, and in which one of the end sides of the long cup is then shaped into a sloped shoulder portion which is diametrically reduced toward the leading end side: wherein the printed decoration is printed on the outer face of the cylindrical trunk portion of the long cup to the portion to be shaped into the shoulder portion at a subsequent treatment, and wherein the pattern or letter of the printed decoration applied to the portion to be shaped into the shoulder portion is distorted to be wider in the upward direction, in comparison with a final desired figure.

5 Claims, 8 Drawing Sheets

METHOD FOR MANUFACTURING CAN BODY PRINTED TO SHOULDER PORTION

BACKGROUND OF THE INVENTION

1. Field of the Invention

The present invention relates to a method for manufacturing a can body such as a bottle-shaped can or an aerosol can, which has a cylindrical trunk portion necked gradually at its upper portion to form a sloped shoulder portion. More particularly, the invention relates to a can body manufacturing method capable of printing a pattern or letter without any distortion not only on the can trunk portion having a completely shaped shoulder portion but also on the shoulder portion.

Here, the word "sloped", as used herein, also means a curved face whose longitudinal section is arcuate, such as a domed shape.

Moreover, the can, as called herein the "bottle-shaped can", also means the can, which is provided with a sloped shoulder portion having the diameter getting smaller from the trunk portion to the leading end, and a cylindrical neck portion merging into said shoulder portion, and covers both cans having and not having a thread portion in its neck portion.

2. Discussion of the Related Art

In recent years, Japan has used a number of such bottle-shaped aluminum cans in the market of beverage cans that a cylindrical and thin trunk portion and a diametrically-small threaded neck portion are integrally shaped through a smoothly sloped shoulder portion. This is because the bottle-shaped can of this kind can be sealed (and resealed) with a threaded cap, and because it is excellent in the container recycling (or raw material reusing) percentage, the shading properties, the gas permeability and the quick content cooling properties. The bottle-shaped cans made of aluminum have been recently employed for beverages also in the United States of America.

Two kinds of resealable bottle-shaped cans have generally spread in the Japanese market. One is the bottle-shaped can of the type, in which a threaded neck portion of a diametrically-small cylindrical shape, a domed shoulder portion and a diametrically-large cylindrical trunk portion are shaped integrally, and in which a separate bottom lid is seamed and fixed on the lower end opening side of the trunk portion. The other is the bottle-shaped can of the type, in which a threaded neck portion of a diametrically-small cylindrical shape, a shoulder portion, a diametrically-large cylindrical trunk portion and a bottom portion are shaped integrally, and in which a frusto-conical or domed shape shoulder portion is formed between the trunk portion and the neck portion.

The neck portion of the bottle-shaped can of the latter type is diametrically larger by about 10 mm than that of the bottle-shaped can of the former type. In the bottle-shaped can of either type, the opening portion can be resealed by putting a Pilfer proof cap on that neck portion.

The method for shaping the bottle-shaped can of the former type is disclosed, for example, in U.S. Pat. Nos. 6,857,304, 6,499,329 and 5,718,352. The method for shaping the bottle-shaped can of the latter type is disclosed in detail, for example, in U.S. Pat. Nos. 5,718,352, 5,704,240 and 6,779,677. Moreover, the method for shaping a shoulder portion having a smooth sloped face, by shaping a bottomed long cup in which one of the end portion is opened from an aluminum sheet or an aluminum sheet alloy, and then necking the open side more than once to reduce the diameter gradually, is disclosed in U.S. Pat. Nos. 5,293,765 and 5,355,710.

To the outer face of such bottle-shaped can, there is applied a printed decoration (i.e., a decorative design made by a print) such as a pattern or letters. One example of this method is described on the bottle-shaped can of the former type. In the prior art, a can body is shaped at first and is then printed. Specifically, a lubricant is applied to both faces of a metal sheet material such as an aluminum alloy sheet having or not a thermoplastic resin coating layer on its both faces. Then, the metal sheet material is subjected to a punching and a drawing to form a shallow cup. Next, this shallow cup is subjected to a re-drawing to reduce the diameter of the cup and to increase the height of the cup, and subjected further to a thinning treatment such as a stretching or an ironing to thin the trunk wall of the cup. Consequently, a bottomed cylindrical long cup having a large height (i.e., a one-end opened seamless can) is shaped. The drawing is applied to the bottom side of this long cup more than once, so as to shape a diametrically-small bottomed cylindrical portion (or a neck portion) and a shoulder portion sloped in a dome shape or a frusto-conical shape. After this, the lubricant is removed from at least the outer face of the long cup, and the outer face of the cylindrical trunk portion is printed. Besides, a printed film may be adhered to the outer face of the can instead of this printing.

This shaping method is disclosed in detail in the specification of U.S. Pat. No. 6,463,776 and is expected to understand itself well by reference. Therefore, a further explanation is omitted.

Here, it is widely executed in the field of can manufacturers to print the outer face of such long cup or can. The printing speed of the long cup is usually about 1,000 cans/minutes or higher.

The long cup having the print on the outer face of its trunk portion is opened by cutting off the leading end portion of the diametrically-small bottomed cylindrical portion (or the neck portion). This opened leading end portion of the diametrically-small cylindrical portion is subjected to a curling to form a curled portion and is subjected to a threading to form a thread on the cylindrical portion below the curled portion. The cylindrical portion below the treated portion is rolled to form an annular recess.

Here, the curling is not necessarily to be carried out prior to the threading, but may be carried out after the threading. It is also possible to start the curling at first and interrupt it midway to carry out the threading, and then complete the remaining curling.

Subsequently, the opening end portion of the diametrically-large cylindrical trunk portion on the opposite side of the neck portion is subjected to a necking-in to reduce the diameter of the opening end portion, and then subjected to a flanging treatment to bend its leading end outward. After this, the opening end portion is seamed with a separate bottom lid. This shaping process is disclosed in U.S. Pat. No. 6,499,329.

According to the method thus far described, however, the long cup is shaped to have the shoulder portion and the bottomed diametrically-small cylindrical portion (i.e., the unopened neck portion), and then a printed decoration such as a pattern or letters is applied to the outer face of the cylindrical trunk portion. Therefore, the printed decoration is not applied in the least to the shoulder portion, which occupies a relatively large area of the bottle-shaped can.

This is reasoned in the following. There exists a printer for printing such sloped portion. However, a printing speed of this printer is a rather slow. Therefore, it is substantially impossible to print the sloped shoulder portion of the bottle-shaped can at a speed of 100 cans/minutes or higher.

In the specification of U.S. Pat. No. 6,463,776, on the other hand, there is disclosed a method for applying a printed decoration to the sloped shoulder portion. This method will be described briefly. The lubricant is removed from at least the outer face of the long cup before the diametrically-small bottomed cylindrical portion and the sloped (or domed or frusto-conical) shoulder portion are formed. Then, the outer face of the trunk portion of the long cup is printed with a pattern or letters, a clear coating film for protecting the printed layer is applied on the printed layer, and the printed layer and the coating film are dried. After this, a lubricant is applied again to at least the outer face of the long cup. Then, the bottom side of the long cup is subjected to a drawing more than once and to a reforming once, so as to form a diametrically-small bottomed cylindrical portion and a smoothly sloped shoulder portion. By way of these steps, the printed decoration is applied not only to the trunk portion of the bottle-shaped can but also to the sloped shoulder portion.

On the other hand, one example of the method for manufacturing the bottle-shaped can of the latter type having a neck portion of a relatively large diameter is disclosed in U.S. Pat. No. 5,293,765. According to this method, a long cup is formed at first. Specifically, a metal sheet material (or an aluminum alloy sheet), which is prepared by applying a lubricant to the both faces of a highly pure, relatively thick aluminum sheet, is subjected to an impacting to shape a bottomed cylindrical long cup all at once. Alternatively, this bottomed cylindrical long cup is shaped by forming a shallow cup by applying a punching and a drawing to a relatively thin aluminum alloy sheet in which a lubricant is applied to both faces, and then applying a re-drawing and an ironing to the shallow cup. The long cup thus formed is trimmed on its opening side to make the longitudinal length even, and then, a lubricant removing treatment, and a degreasing/chemical conversion/rinsing treatments for improving adhesiveness of the printing ink and the paint with the inner and outer surfaces of the cup, is applied to both inner and outer faces of the cup. After this, a decorative print and a clear coating (e.g., finishing varnish) for protecting the printed face are applied at least the outer circumference of the trunk portion of the cup. Moreover, the cup is sprayed on its entire inner face with a protecting paint.

After this, the trunk portion of the long cup is subjected to a mouth drawing or a multiple necking-in repeatedly more than one time, thereby to form the diametrically-small cylindrical neck portion and the frusto-conical shoulder portion. Then, a threaded portion is formed in the central portion of the neck portion.

If desired, a curled portion may be formed on the leading end of the neck portion, and an annular recess may also be formed below the threaded portion (as referred to JP-A-2000-191006).

As disclosed in the specifications of U.S. Pat. Nos. 4,098,420 and 4,256,233, for example, there is known an easily openable aluminum cap with a tab, comprising: a top portion; a skirt portion depending from the circumferential edge of the top portion; the tab extending from the skirt portion to be pinched by fingers; a seal member on the inner face side near the boundary between the top portion and the skirt portion; and a score line (or a notch line) extending from the skirt portion near the two sides of the tab to the top portion. This aluminum cap is put on the neck portion of the bottle-shaped can, and the lower portion of the skirt portion of the cap is crimped (or bent inward) by a capper to seal the neck portion of the bottle-shaped can. In case this cap is used, therefore, the cap is put on the neck portion by a crimping. This makes it unnecessary to form the threaded portion in the neck portion of the bottle-shaped can, but makes it sufficient to form the curled portion at the upper end of the neck portion.

In the case of the aerosol can, on the other hand, the shoulder portion can be formed by a shaping method similar to that of the case of the bottle-shaped can, i.e., by the drawing, the reforming and the necking-in.

One example of this shaping procedure is briefly described. First of all, the steps to that of forming the long cup are absolutely identical to those of the bottle-shaped can manufacturing process so that their description is omitted. Next, the lubricant is removed from at least the outer face side of the long cup, and the open end of the long cup is trimmed to have an even height. Then, the outer face side of the trunk portion of the long cup is printed substantially all over its surface with a pattern or letters, and the protective clear coating is instantly applied to the printed face. After this, the printing ink layer and the coating layer are dried.

Although the printing step and the coating step of the long cup is not limited to the above method, it may also be carried out by the dry offset printing method, which uses the dry offset printing/coating apparatus for a two-piece can, and which is well known and commonly used in the can manufacturing field.

Here, the material for shaping the long cup may be exemplified not only by the resin-coated metal sheet, which is provided in advance on both faces of a metal sheet with a protective coating film such as a thermoplastic resin coating layer or a thermosetting resin coating layer, but also by a metal sheet which is not coated with any resin.

In case the metal sheet having no resin coating is used, for example, the long cup is shaped by a shaping process similar to the aforementioned one after the lubricant was applied to both faces of the metal sheet.

Next, the long cup is trimmed at its open end side to have an even height and is cleared of the shaping lubricant sticking to the inner and outer faces thereof. Moreover, the long cup is subjected on its two faces to a surface treatment such as a forming treatment and is dried. After this, an outer face of the trunk portion of the long cup is printed and protectively coated, and an outer face of the bottom portion and its vicinity is protectively coated. On the other hand, an inner face of the long cup is also protectively coated. In other words, the timing of the trimming step of the open end side, and an application of the protection coating to the outer face of the bottom portion of the long cup and its vicinity and to the inner face of the long cup, are different from that of the case, in which the long cup is shaped from the resin-coated metal sheet, which is provided in advance on its two faces with the resin film.

After this, the lubricant is applied to at least the outer face (i.e., the outer faces of the trunk portion and the bottom portion) of the long cup. Then, the long cup is subjected at its bottom portion to plural drawings as for the aforementioned bottle-shaped can, and is subjected to the reforming to form the shoulder portion having a dome shape (or a frusto-conical shape) and the bottomed diametrically-small cylindrical portion. The shoulder portion thus shaped is printed on at least one half of the trunk portion.

After this, the leading end portion of the diametrically-small cylindrical portion is cut and opened, and the open end portion thus formed is curled outwardly to form the curled portion. Moreover, the trunk portion is subjected at its open end portion to the necking-in and the flanging, and the flanged portion is fixedly seamed with a separate bottom lid thereby to complete the aerosol can.

On the other hand, the method for manufacturing the aerosol can of the type, in which the open end of the long cup is repeatedly subjected to plural necking-in treatments so that it is diametrically reduced to form the sloped shoulder portion and the diametrically-small cylindrical neck portion, is exemplified by the following manufacturing process. The illustration of this manufacturing process is omitted.

The metal sheet, which is prepared by coating its two faces with the thermoplastic resin film and by coating the two faces with a high-temperature volatile lubricant, is subjected to the punching to produce a blank. This blank is subjected to a drawing to form a shallow cup. This shallow cup is subjected to plural drawings and plural ironings to form a flanged long cup. After this, this long cup is heated to volatilize and remove the lubricant from its outer face, and is trimmed at its open end to an even height.

After this, the trunk portion of the long cup is printed and coated all over its face by the dry offset printing method, and the printed ink layer and the coating layer are dried.

After this, the lubricant is applied to the open end side of the outer face of the trunk portion of the long cup. Then, the open end portion of the long cup is repeatedly subjected to drawings of multiple times or to necking-in treatments of multiple stages thereby to form the frusto-conical or domed shoulder portion and the diametrically-small cylindrical short neck portion.

After this, the leading end portion of the neck portion is trimmed and then curled outwardly to form the curled portion. As a result, there is completed the bottomed long aerosol can, in which not only the trunk portion but also the shoulder portion are printed, and in which the bottom portion, the trunk portion and the shoulder portion are integrally formed.

No matter what type of the can, e.g., the aforementioned bottle-shaped can or the aerosol can, the printed decoration is applied to the cylindrical trunk portion of the long cup before the smooth shoulder portion (and the neck portion) is formed. Thus, the printed decoration is applied not only to the formed trunk portion of the can body but also to the sloped shoulder portion.

However, the following problems arise in the can thus shaped in that sequence.

This is described on the example of the case, in which the bottom portion of the long cup is subjected to plural drawings.

Specifically, if the printed decoration to be applied to the portion near the bottom of the cylindrical trunk portion of the long cup (i.e., the portion to be formed into the shoulder portion by the subsequent treatment) is a pattern or letters having a clear shape, the pattern or letters applied to said portion are deformed and distorted by the subsequent treatment. Specifically, the applied pattern or letters are converged and get thinner (or narrower) in upward direction (i.e., to the bottom portion), according to the progress of the reshaping (or the reforming) of said portion from the cylindrical shape to the sloped shoulder portion.

Especially, in case the pattern or letters is applied over the trunk portion and the shoulder portion of the can body, only a portion i.e., the shoulder portion is tapered. This gives such an impression that the applied pattern or letters is/are considerably distorted in its entirety.

This example is shown in FIG. 7A and FIG. 7B. The lefthand drawings present a printed decoration 52 printed on a trunk portion outer face 51 of a long cup 50, and the righthand drawings present a printed decoration 56 of a bottle-shaped can 55 just after a diametrically-small neck portion 53 and a domed shoulder portion 54 were formed.

This likewise occurs in case the aerosol can, the shoulder portion of which is formed by a similar method.

On the other hand, in case of the bottle-shaped can (or the aerosol can), which is prepared by subjecting the open end side of a long cup printed all over its cylindrical trunk portion with the printed decoration to the drawings of multiple times and the necking-in treatments of multiple stages thereby to form a smoothly sloped shoulder portion and a diametrically-small cylindrical portion (or a smoothly sloped shoulder portion), the bottle-shaped can is troubled by a problem that the printed decoration applied to the sloped shoulder portion below the open end is converged.

SUMMARY OF THE INVENTION

An object of the invention is to solve the problems thus far described, and more particularly, to form a printed decoration such as a pattern or letters without distortion on not only the trunk portion but also the shoulder portion of a can body, in which the shoulder portion is sloped above the cylindrical trunk portion. Here, the can body, to which the invention is directed, covers a bottle-shaped can, an aerosol can and a can of another type, which is provided with an open portion having a considerably larger diameter than that of the trunk portion and a sloped shoulder portion.

In case the can body is manufactured by the method of the invention, the diametrically-small cylindrical neck portion and the sloped shoulder portion are shaped at first by forming a long cup of a metal sheet material and by applying the necking or the drawing to the open end side or the bottom side of the long cup. The present invention is characterized: in that the printed decoration is applied in the can body forming procedure from the outer face of the trunk portion of the long cup to the portion to be formed into the shoulder portion; and in that at least the pattern or letters of the printed decoration to be applied to the portion to be formed into the shoulder portion is distorted to be wider in upward direction, (that is, the letters becomes the thicker upward, and the pattern becomes the wider upward) in comparison with the desired final figure of the printed decoration (or the shape of the pattern or letters).

According to the invention, the decoration printed on the portion to be formed into the shoulder portion is distorted as described hereinabove, and the width of the printed pattern or letters gets narrower according to the progression of subsequent forming of the shoulder portion. Therefore, the preset distortion is corrected as the progression of the forming of the shoulder portion. As a result, desired shape of the decorative pattern or letters is printed on the shoulder portion of the can body.

According to the method of the invention, it is also possible to print at least any one of the decorative pattern or letters over the portions to be formed into the trunk portion and the shoulder portion of the can body, and to distort only the portion of the pattern or letters on the portion to be the shoulder portion to have the wider or thicker width as it goes upward in comparison with the desired final shape.

According to the invention, therefore, the diameter of the shoulder portion is relatively smaller than that of the trunk portion, and the printed decoration is distorted taking into consideration the difference in the outer circumferential length. For this reason, the decoration can be fairly printed over the trunk portion and the shoulder portion, even after the long cup of a simple cylindrical shape is formed into the can body having the shoulder portion. In other words, the decorative pattern or letters can be printed with the normal thickness and the well-balanced width and length in its entirety.

Moreover, the can body to be manufactured by the method of the invention may be a can body, in which the open end of the in-process long cup is formed into the bottom portion of the can body by fitting a bottom lid thereon, and the close end is formed into the neck portion to which the cap is attached. More specifically, according to the method of the invention, the bottom portion of the long cup and the trunk portion on the bottom side are shaped into the diametrically-small bottomed cylindrical portion and the sloped shoulder portion. Then, in order to form the neck portion, the leading end of the diametrically-small bottomed cylindrical portion is cut to be opened, and a peripheral wall is threaded. On the other hand, a separate bottom lid is attached to the open end portion of the trunk portion of the long cup by a seaming method. According to the method of the invention, moreover, it is also possible to print the decoration on the trunk portion of the cup in the direction in which the upper portion of the printed decoration is directed to the bottom portion of the long cup, and then shape the diametrically-small bottomed cylindrical portion and the sloped shoulder portion by applying the plural drawing or necking treatments to the bottom portion of the long cup and the trunk portion on the bottom side.

According to the invention, therefore, it is possible to manufacture the bottle-shaped can of the type, in which the trunk portion, the shoulder portion and the neck portion are integrally formed, in which the separate bottom lid is attached to the open end of the trunk portion, and in which a beautiful decoration having no distortion is printed not only on the trunk portion but also on the sloped shoulder portion.

Moreover, the invention can be applied to the case of manufacturing the aerosol can. In this case, the decoration is printed on the trunk portion of the long cup in the direction in which the upper portion of the printed decoration is directed to the bottom portion and the bottom side of the long cup. The portion of the decoration printed on the portion to be the shoulder portion is distorted in advance, as described hereinbefore. Then, the bottom portion of the long cup and the trunk portion on the bottom side are subjected to the plural drawing or necking treatments to shape the diametrically-small bottomed cylindrical portion and the sloped shoulder portion.

According to the invention, therefore, it is possible to manufacture the aerosol can of the type, in which the trunk portion, the shoulder portion and the neck portion having the curled portion are integrally formed, in which the separate bottom lid is attached to the open end of the trunk portion, and in which a beautiful decoration having no distortion is printed not only on the trunk portion but also on the sloped shoulder portion.

Furthermore, according to the method of the invention, it is also possible to print the decoration on the long cup to the portion to be formed into the shoulder portion, in the direction in which the upper portion of the printed decoration is directed to the open end portion of the long cup, before the long cup is subjected to the necking treatments to the open end portion of the long cup.

According to the invention, therefore, a decorative pattern or letters is printed on the trunk portion and the shoulder portion, and the printed decoration on the shoulder portion is not unnaturally distorted but in a desired shape. It is, therefore, possible to manufacture a bottle-shaped can or a can having a shoulder portion similar to that of the bottle-shaped can and a neck portion opening comparatively wider, which is shaped integrally in its entirety so that it looks so decorative as to give an excellent appearance at the store.

Moreover, the method of the invention can also be applied to manufacturing the aerosol can. In this case, as the aforementioned bottle-shaped can, a decorative pattern or letters is printed on the trunk portion and the shoulder portion, and the printed decoration on the shoulder portion is not unnaturally distorted but in a desired shape. It is, therefore, possible to manufacture an aerosol can, which is integrally shaped in its entirety so that it looks so decorative as to give an excellent appearance at the store.

The above and further objects and novel features of the invention will more fully appear from the following detailed description when the same is read with reference to the accompanying drawings. It is to be expressly understood, however, that the drawings are for purpose of illustration only and are not intended as a definition of the limits of the invention.

DETAILED DESCRIPTION OF THE PREFERRED EMBODIMENT

Hereinafter, the can body manufacturing method of the invention will be described in detail with reference to the accompanying drawings. Here is described the manufacture of a bottle-shaped can of the type, in which the bottom side of a long cup is shaped into a sloped shoulder portion and a diametrically small neck portion by applying a plurality of drawings.

Figure 1:
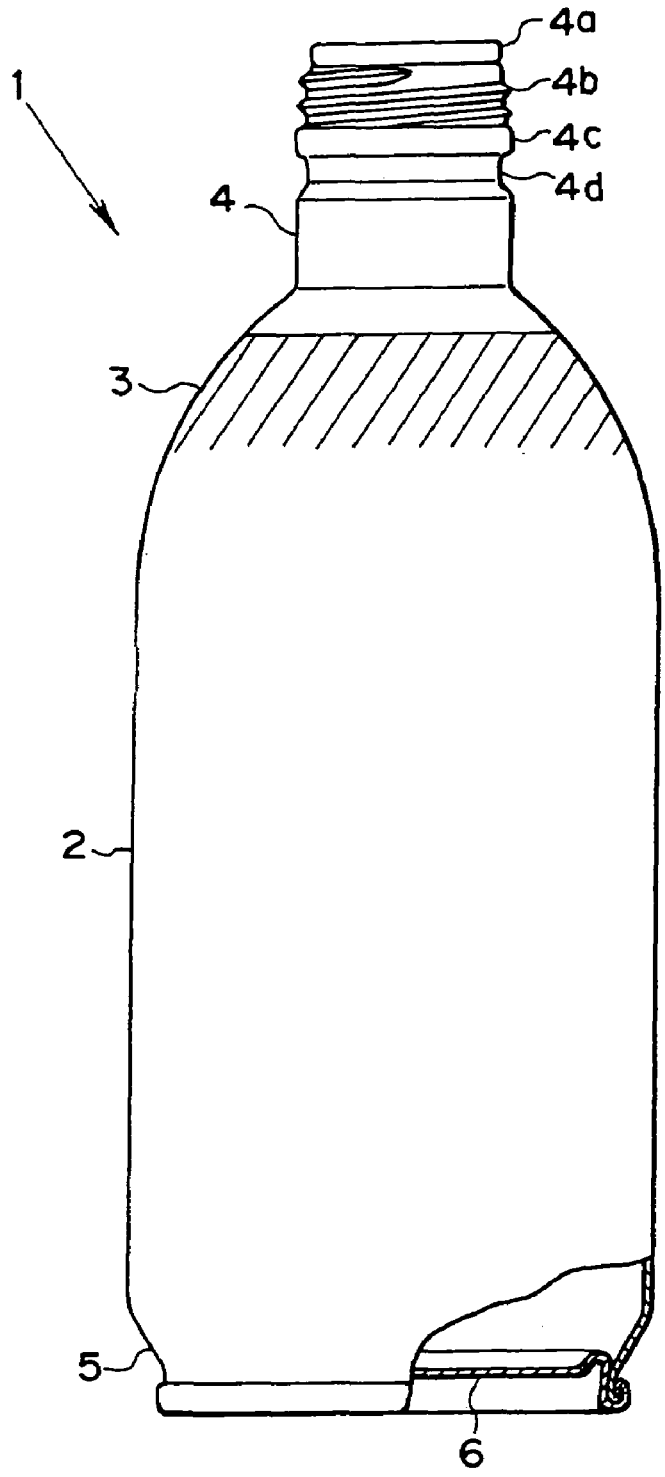
FIG. 1 is a partially cut-away side elevation showing the appearance of a bottle-shaped can, i.e., one example of the can body, to which a method of the invention is applied.

First of all, the bottle-shaped can will be explained as one example of the can body, to which the method of the invention is applied. As illustrated in FIG. 1, a dome shaped shoulder portion 3 whose longitudinal section is arcuate and a diametrically small cylindrical neck portion 4, are integrally formed above a diametrically large cylindrical can trunk 2. A neck-in portion 5 is formed at the lower end of the can trunk 2. To the opening lower end side of a neck-in portion 5, a separate bottom lid 6 is attached by a seaming method (i.e., to the flanged portion formed at the lower end of the neck-in portion 5). A desired decoration (i.e., designs of printed letters or patterns) is printed on the outer face side of the can body except the bottom lid 6, that is, on the portion below the hatched portion of the shoulder portion 3. Here, the specific example of the printed decoration is omitted from FIG. 1.

The neck portion 4 is provided with an outwardly curled portion 4*a*, a thread portion 4*b*, an annular bead portion 4*c* and a diametrically small cylindrical portion 4*d*. Here, the annular bead portion 4*c* and the underlying diametrically small cylindrical portion 4*d* are disposed for retaining a pilfer-proof band of the cap on the neck portion 4. When a (not-shown) pilfer-proof cap made of a metal is mounted on the neck portion 4, a most part of the skirt of the cap is threaded, and the lower end portion of the pilfer-proof band is deformed by rollers of a capper. Specifically, the lower end portion of the pilfer-proof band positioned at the lower end of the cap is pressed onto the lower wall (or the lower step portion) of the annular bead portion 4*c*, by fitting a skirt roller of the capper into the diametrically small cylindrical portion 4*d* over the lower end portion of the pilfer-proof band. As a result, the cap is locked on to the neck portion 4.

Figure 2:
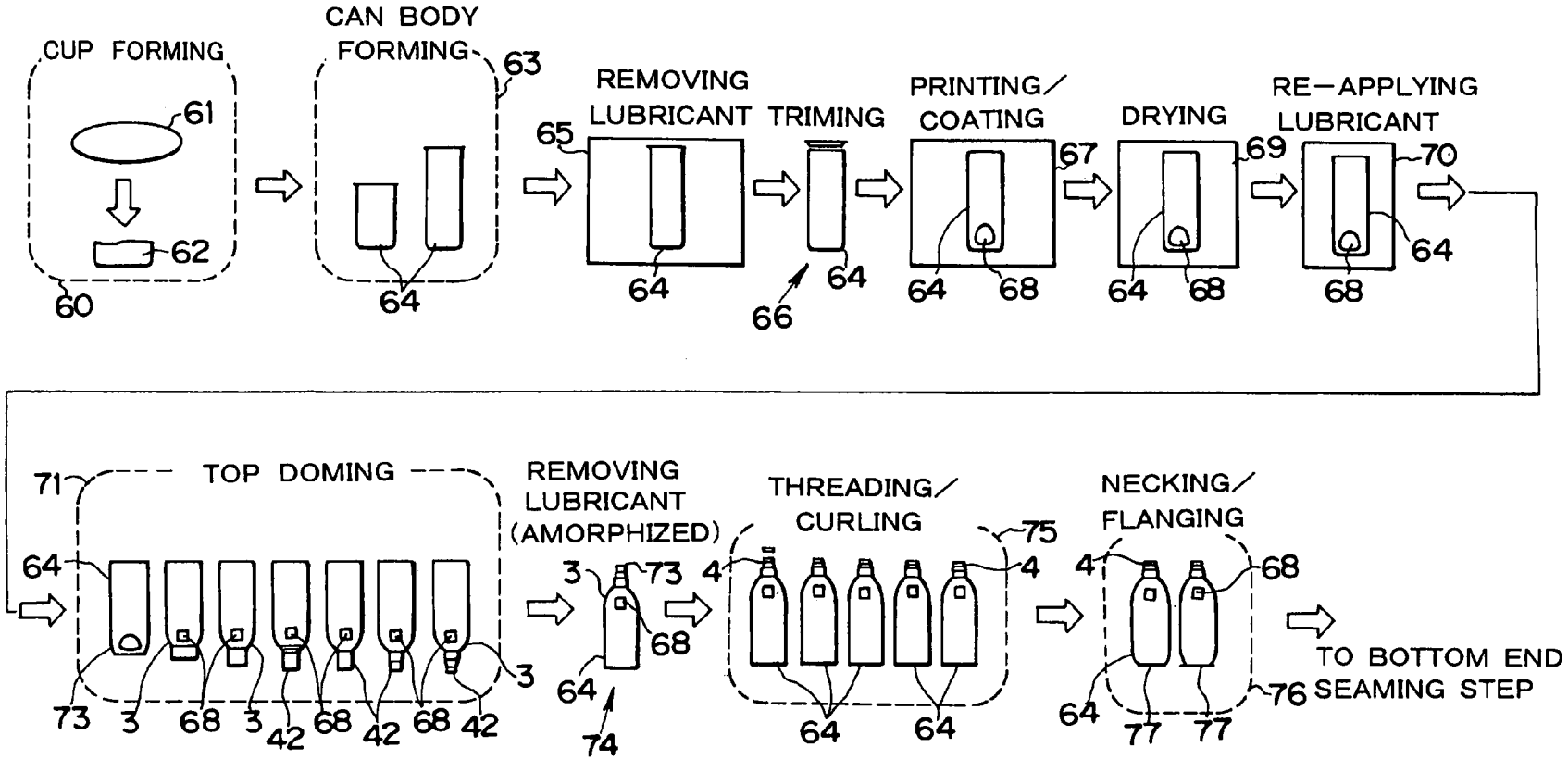
FIG. 2 presents step diagrams showing the entirety of the bottle-shaped can manufacturing method schematically.

Here is schematically described one example of an overall method for manufacturing such a bottle-shaped can 1. With respect to a material of the bottle-shaped can 1, a metal sheet material (i.e., a resin-coated metal sheet) is to be used. On both faces of a can making metal sheet, e.g., an aluminum alloy sheet or a surface-treated steel sheet, there is formed a thermoplastic resin coating layer in an amorphous state, and a lubricant is further applied thereon. As illustrated in FIG. 2, first of all, a disc-shaped blank 61 is punched out from the metal sheet material at a cup shaping step 60. Then, the disc-shaped blank 61 is shaped into a shallow cup 62 by a drawing treatment. At a subsequent can trunk shaping step 63, at least one or more times of re-drawing, and at least one of a thinning treatment, such as a stretching and an ironing is applied to the shallow cup 62. Consequently, the shallow cup 62 is shaped into a bottomed cylindrical long cup (i.e., a seamless can) 64 having the thinned trunk portion.

Then, the lubricant is removed from at least the outer face of the long cup 64 at a lubricant removing step 65, and an open end of the long cup 64 is trimmed to a predetermined length at a trimming step 66. The long cup 64 thus prepared is transferred to a printing/coating step 67, as the customary way of manufacturing the trunk of a two-piece can. At the printing/coating step 67, a desired printed decoration (e.g., a design print of letters or decorative patterns) 68 is printed on the cylindrical trunk portion of the long cup 64. Then, the printed face is coated with a top coating layer (i.e., a clear coating), and the printed ink layer and the top coating layer are dried sufficiently at a drying step 69.

Figure 5A:
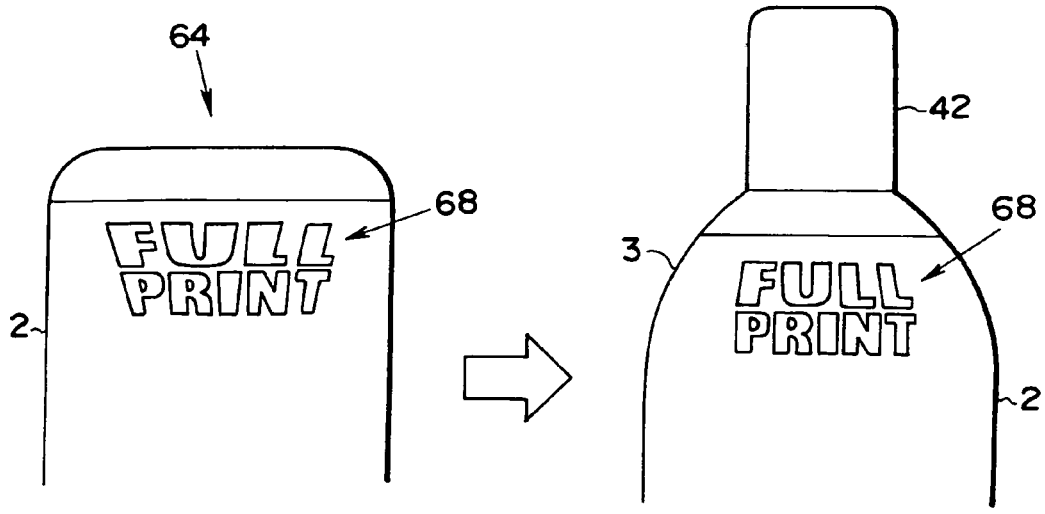
FIG. 5A is a side elevation showing examples of the printed decoration, which has been applied to a portion (to be shaped into the shoulder portion) near the bottom portion of the can trunk of the long cup, and the printed decoration, which has been changed by shaping the shoulder portion, in accordance with the method of the invention.
Figure 5B:
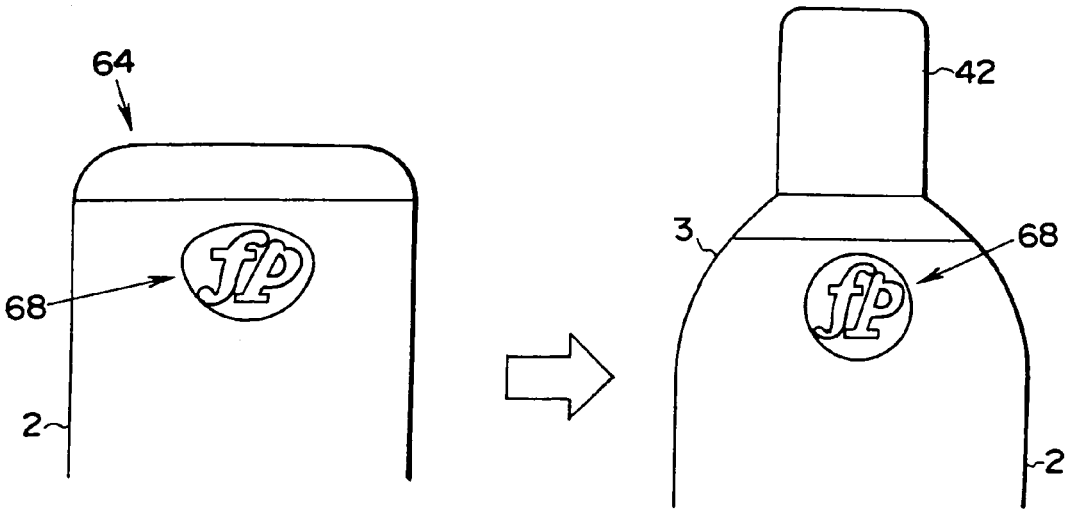
FIG. 5B is a side elevation showing another examples of the printed decoration, which has been applied to a portion (to be shaped into the shoulder portion) near the bottom portion of the can trunk of the long cup, and the printed decoration, which has been changed by shaping the shoulder portion, in accordance with the method of the invention.

The portion of the decoration printed at the printing/coating step 67 on the shoulder portion to be formed at the subsequent shaping step is distorted in advance, so as to compensate the deformation resulting from the forming process of the shoulder portion. For example, as illustrated in FIGS. 5A and 5B, the width of the letters and the patterns become wider toward the can bottom side.

Figure 8:
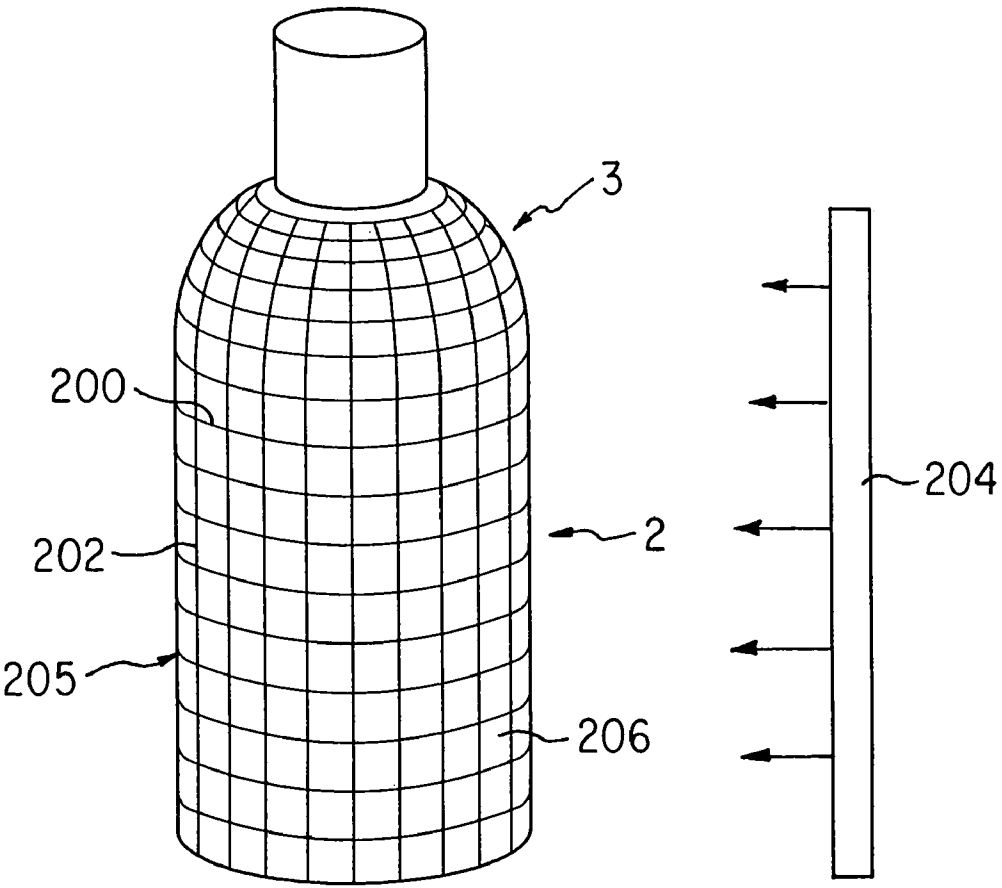
FIG. 8 is a side elevation showing the bottle shaped can having a lattice pattern printed thereon by a printing plate.

Several methods can be conceived to distort the printing design of the patterns and/or letters in advance, only at the portions to be shaped into the shoulder portion. One example will be explained hereafter with reference to FIG. 8.

In this example, first of all, a number of transverse lines 200 extending horizontally at an equal interval, and a number of longitudinal lines 202 extending vertically to those transverse lines, are printed on the outer face of the trunk portion 2 of the long cup in which both inner and outer faces are coated with the resin film, using a printing plate schematically illustrated at 204. Consequently, a lattice pattern 205 in which a number of circumferential lines or annular lines rounding in the circumferential direction, and in which a number of vertical lines intersect those circumferential lines at a substantially equal interval, is printed on the outer face of the trunk portion 2 of the long cup. The circumferential lines or annular lines are situated at an interval of 1 mm for example, between the vicinity of the upper end to the vicinity of the lower end of the trunk portion. On the other hand, for example, one hundred and twenty of the vertical lines are situated longitudinally (i.e., in a direction along the profile line of the trunk portion) in the circumferential direction at an interval of 3 degrees with respect to an axis of the long cup. In the case an external diameter of the long cup is 66mm, an interval between each vertical lines is about 1.7 mm. Consequently, a series of quadrangles 206 defined by four lines are printed.

Then, a protective coating is applied to the printed face of the long cup, and the printing ink and the protective coating are dried.

Next, as described above, the drawing and re-drawing are applied to the bottom side of the long cup, and then, re-drawing is applied thereto once again so as to form the shoulder portion 3. Subsequently, the shoulder portion is formed into the smoothly curved shoulder portion and the diametrically small cylindrical portion, by applying the reforming thereto.

In the shoulder portion formed at those shaping steps, the lengths of the individual four sides of each quadrangles 206 defined by the circumferential lines (or the annular lines) 200 and the vertical lines 202 intersecting those circumferential lines are measured. These measured values are compared with the length of the individual sides before the shoulder portion is shaped, or the individual sides of the quadrangle on the nondeformed trunk portion defined by the circumferential lines and the vertical lines. By these measurements and comparisons, the changing amount of the individual portions in the longitudinal direction as well as in the transverse direction are calculated.

Preferably, the lengths of those vertical lines are measured from a position substantially perpendicular to the inclination of the shoulder portion. In the case of the shoulder portion of the dome shape shown in FIG. 1, the measurements can be made by means of a projector (e.g., Nikon PROFILE PROJECTOR V-16E of NIPPON KOGAKU KK of Japan) at an angle of about 30 degrees with respect to the axis of the long cup.

In this measurement, eight portions were measured from different angles on a common circumference, and their average value was calculated.

In the case the shoulder portion is a frusto-conical shape whose inclination is about 45 degrees with respect to the axis of the long cup (or an angle of inclination from the trunk portion), the measurements were made using same projector from an angle of 45 degrees with respect to the axis of the cup.

On the other hand, the lengths of those annular lines were measured by means of a contour meter using a laser (e.g., LASER SCAN MICROMETER LS, LS-5040T, and LS-5040R of KEYENCE CORPORATION of Japan).

In this measurement, the average value of the measured numerical values of four different positions of the long cup on the same circumference, was converted into the size of the unit (i.e., the portion defined by the four lines) of the individual measured portions.

Then, a changing rate $\alpha$ (i.e., decreasing ratio or increasing ratio) is calculated. The changing rate $\alpha$ is a rate of change in the transverse (i.e., circumferential) length and the longitudinal (i.e., in the height direction) length of the portion deformed as a result of being formed into the shoulder portion (i.e., the portion wherein its size is decreased or increased after the printing). For example, in case the length at the printing time is A mm, and the changed size is B mm, B can be expressed by the following formula:

$$B=\alpha\times A.$$

The ratio $\alpha$ becomes smaller than "1" in the decreasing case, and becomes larger than "1" in the increasing case.

At the same time, an inverse number of the changing rate $\alpha$ (decreasing ratios or the increasing ratios) is calculated. Namely, the inverse number (or reciprocal number) of the changing rate $1/\alpha$ is the correction value.

When preparing a printing plate for the printing design, the portion of the shape of a pattern, and/or the width and length of letters to be formed into the shoulder portion, are increased (or decreased) in advance by the aforementioned correction values.

Thus, the long cup is formed from the aforementioned metal sheet material by the aforementioned shaping method, and the lattice pattern is printed on the outer face of the long cup, at least on the portion to be reshaped into the sloped shoulder portion at the subsequent step. As mentioned above, the lattice pattern is composed of the circular or annular lines situated at the equal interval, and the vertical lines situated at the equal interval. Then, multiple steps of the shaping treatments are applied to the bottom side of long cup by the predetermined shaping tools. As a result, the bottom side of the long cup is shaped into the sloped shoulder portion and the diametrically small bottomed cylindrical portion. Then, sizes of each quadrangle (i.e., the length in the circumferential direction and the length in the longitudinal direction) formed at the shoulder portion are measured. This measurement may be carried out on whether the quadrangles of all over the shoulder portion, or on the quadrangles picked up at a predetermined interval. The measured values are compared with the original size of quadrangles when those were printed, thereby calculating the decreasing or increasing ratios of the sizes. Based on the calculated decreasing or increasing ratios, the aforementioned correction values as the reciprocal number of the decreasing or increasing ratios are calculated.

Namely, in case the portion of the cylindrical trunk portion is shaped into the sloped shoulder portion, the decoration on the portion to be shrunk has to be increased in its size both vertically and horizontally when it is printed, so as to compensate the shrinkage. On the contrary, in case the decoration is printed on the portion to be elongated when it is shaped into the sloped shoulder portion, the size of the decoration has to be decreased both vertically and horizontally when it is printed, so as to compensate the elongation. For these necessities, the increasing or decreasing amount of each portion is calculated in advance.

The extents of distortion to be given to the letters or design before printed, that is, the correction values for the desired final shapes or sizes of printed decoration are obtained on the basis of those increasing or decreasing amount measured by the preceding investigation.

When preparing the printing plate for the printing design, the size of the desired patterns or letters which are to be printed on the portion to be shaped into the shoulder portion, is distorted in advance by the aforementioned correction values. Needless to say, the common correction value is used on the common circumference.

Then, the distorted decoration is printed on the outer face of the long cup using the printing plate having the distorted design of the decoration, and the drawing and the reshaping are applied predetermined times to the bottom side of the long cup. Consequently, the desired decoration, i.e., the desired patterns and letters are printed on the shaped shoulder portion.

In case the metal sheet material used for the can manufacturing is not coated with the resin film such as a thermoplastic resin film, the method having the following steps is to be carried out. First of all, a disc-shaped blank is punched out from the metal sheet material, and is formed into a shallow cup by applying a drawing treatment. This shallow cup is subjected to a re-drawing to form a higher cup having a little smaller diameter. Then, this re-drawn cup is shaped into a long cup having a thin trunk portion by a re-drawing, and a stretching and/or ironing. This long cup is trimmed at its open end portion, and then, a degreasing treatment and a conversion treatment are applied to both inner and outer faces. The long cup thus treated is rinsed with deionized water, and then dried on its both inner and outer faces with hot air. Next, the outer face of the trunk portion of the cup is printed and coated, and the protective coating is further applied to the outer face of the bottom portion and its vicinity. Those printing and coating are then dried. Subsequently, a protective coating is applied to the inner face and then dried. At this printing/coating step, the decorative letters and pattern printed on the portion to be shaped into the shoulder portion at the subsequent step is designed to become thicker and wider as it getting closer to the bottom side.

Reverting to FIG. 2, at a lubricant reapplying step 70, a high-temperature volatile lubricant is applied to the outer face of the trunk portion and the bottom portion of the bottomed cylindrical long cup 64, in which the trunk portion is printed as described hereinbefore. Then, the long cup 64 is transferred to a top doming step 71. At this step 71, the bottom side corner portion (i.e., the bottom portion and the trunk portion near the bottom) of the long cup 64 is preliminarily shaped into a curved shoulder face 72 whose longitudinal section is arcuate. Here, the curved shoulder face 72 is an intermediate curved face jointing the shoulder portion formed at subsequent steps and the trunk portion already formed into cylindrical shape. Subsequently, a plural time of the drawing is applied to the bottom side of the long cup 64, and after that, a reshaping step is carried out to smoothen the shoulder portion. As a result of carrying out these shaping treatments, the bottle-shaped can: which has the shoulder portion 3 whose longitudinal section is arcuate, and the unopened neck portion 4; and in which the lower end portion of its trunk portion (i.e., at the end portion on the opposite side of the neck portion) is opened.

At this stage, the shape of the printed decoration 68 becomes normal, which has been applied to the portion shaped from the cylindrical trunk portion into the shoulder portion 3 whose longitudinal section is arcuate. Specifically, width of the printed decorative letters is well-balanced, and the width of the printed decorative pattern is not tapered. In other words, the printed decoration 68 is shaped into an intended shape.

Subsequently, at a lubricant removing step 74, the can body is heated to volatile off the high-temperature volatile lubricant, and to put the thermoplastic resin coating layer coating both faces of the can body into an amorphous state. Specifically, the can body is heated to a temperature in which the high-temperature volatile lubricant is volatilized, and further heated to a temperature higher than the melting point of the thermoplastic resin layer coating both inner and outer faces of the can body. This can body is then quenched.

At a subsequent threading/curling step 75, the leading closed end of the unopened neck portion 4 is trimmed and opened, and then shaped into an annular externally curled portion. On the other hand, the threaded portion for fastening the cap is formed on the cylindrical circumferential wall of that neck portion 4. Also, the annular recess is formed on the cylindrical circumferential wall below the threaded portion, at a predetermined distance from the lower end of the threaded portion. As a result, the annular beaded portion is formed above the annular recess, and the diametrically small cylindrical portion is formed below the annular recess.

As has been described hereinbefore, the order to form the curled portion or the threaded portion is arbitrary. It is also possible to once interrupt the forming of the curled portion and form the threaded portion, during the procedure to complete the curled portion.

Here, in the light of the workability at the subsequent steps, it is preferable to put the thermoplastic resin coating layer into an amorphous state when the can body is heated to remove the high-temperature volatile lubricant, however, it is not essential. In case the resin coating both inner and outer faces of the can body is a thermosetting resin or composed mainly of the thermosetting resin, this step of putting the resin layer on the can body into an amorphous state is also not carried out when removing the lubricant.

At a subsequent necking-in/flanging step 76, a necking (or a diameter reducing treatment) and a flanging are sequentially applied to an open end portion 77 of the lower end of the trunk portion on the opposite side of the neck portion 4. Then, a separate bottom lid pressed from a metal sheet is attached to the flanged portion formed on the lower end opening side of the trunk portion by a double-seaming method, using a (not-shown) known seamer (i.e., a can lid seaming machine). As a result, the bottle-shaped can, as shown in FIG. 1 is completed.

The specific embodiment thus far described has been directed to the case for manufacturing the bottle-shaped can having the domed shoulder portion. However, the shape of the shoulder portion of the can body of the invention should not be limited thereto but may be any kind of shape.

Another example of the shape of the shoulder portion can be a frusto-conical shape, and the method for shaping the bottle-shaped can having the shoulder portion of the frusto-conical shape is disclosed in detail in the specification of U.S. Pat. No. 6,499,329. The bottle-shaped can of the invention can also be shaped by the method disclosed therein.

A preferred specific embodiment of the bottle-shaped can manufacturing method according to the manufacturing process thus far described will be described more in detail.

First of all, a metal sheet material as a raw material is a resin-coated metal sheet. This resin-coated metal sheet is prepared by laminating both faces of an aluminum alloy sheet with a thermoplastic resin film of a polyester resin, a polypropylene resin or the like in advance. A thickness thereof including the thermoplastic resin films is about 0.1 to 0.4 mm. More specifically, an aluminum alloy sheet to be used is 3004H191 (Japanese Industrial Standards) having a thickness of 0.315 mm. A mixed resin film containing a polybutylene terephthalate resin (PBT) and a polyethylene terephthalate resin (PET) a thickness of which is 20 microns (PBT:PET=60:40), is laminated on both inner and outer faces of the aluminum alloy sheet.

Moreover, one or more kind of lubricant, e.g., normal butyl stearate, fluid paraffin, petrolatum, polyethylene wax, hydrogenation food oil, palm oil, synthetic paraffin and dioctyl sebacate or the like, is/are applied to the metal sheet (i.e., the resin-coated metal sheet), in which both sides thereof are covered with the thermoplastic resin film layers. At the cup shaping step 60, the blank 61 for each can is punched out from the coated metal sheet material to which the lubricant has been applied, and the blank 61 is drawn to be shaped into the shallow cup 62. For example, a diameter of the blank 61 punched into a disc shape is 170 mm, and the blank 61 is drawn into a shallow cup shape having a height of 48.3 mm and an external diameter of 100 mm.

At the trunk shaping step 63, the re-drawing is applied to the shallow cup 62 two more times, and the stretching is applied to the shallow cup together with one of those re-drawing treatments. Then, the ironing is applied to the stretched cup. Consequently, there is shaped the bottomed cylindrical long cup (or the seamless can) 64, which has a smaller diameter, a larger height, and a thinner trunk portion in comparison with those of the initial cup. Subsequently, the open end side of the long cup 64 is trimmed to align the height (i.e., the length of the cylinder in the axial direction) of the cup.

For example, the shallow cup 62 having a height of 48.3 mm and an external diameter of 100 mm is shaped into the long cup 64 having a height of 171.5 mm or more and an external diameter of 65.9 mm, and the long cup 64 is then trimmed to align the height to 171.5 mm.

At the lubricant removing step 65 for removing the lubricant from the long cup 64, the lubricant such as normal butyl stearate, fluid paraffin or synthetic paraffin is removed from both inner and outer faces of the cup 64. For example, the lubricant is rinsed away by spraying a well-known degreasing agent and water or hot water to the inner and outer faces of the cup 64. Alternatively, in case a high-temperature volatile lubricant is used, the long cup 64 is heated to 200 to 300° C. (preferably 255 to 300° C.), so as to volatilize away the lubricant.

Here, the lubricant adhering to the inner face of the long cup 64 is not necessarily removed at this stage, however, the lubricant adhering to the outer face of the long cup 64 has to be removed certainly, so as to ensure the satisfactory adhesiveness of the printing ink and coating material at the later printing/coating step 67.

Although not illustrated, at the printing/coating step 67 subsequent to the lubricant removing step 65, the cylindrical trunk portion can be printed and coated (or overcoated) on its outer face by absolutely same method as that of the case of the two-piece can (i.e., the seamless can wherein one of its end portions is opened) of the prior art. Examples of an apparatus for these operations are disclosed in the specifications of U.S. Pat. Nos. 3,766,851, 4,048,917, 4,092,949, Japanese Patent Laid-Open No. 57-170758, Japanese Patent Laid-Open No. 57-178754 and so on. These apparatus carry out a multi color printing and an overcoating consecutively on the outer face of the cylindrical the long cup 64, while transferring the two-piece can fixed by the mandrel of the printing apparatus.

The portion of the letters and/or pattern of the printed decoration 68 printed at the printing step 67, on the portion of the long cup 64 which is to be shaped into the shoulder portion 3 at the subsequent step, is/are designed to become thicker and wider as its goes closer to the bottom side. In short, the size of the printed decoration 68 is obtained by multiplying the sizes of the individual portions of the normal design by the aforementioned correction values. Therefore, the printed decoration of the normal design is printed on the unchanged portion of the cylindrical trunk portion, which is not reshaped to be inclined at the subsequent steps.

Figure 4:
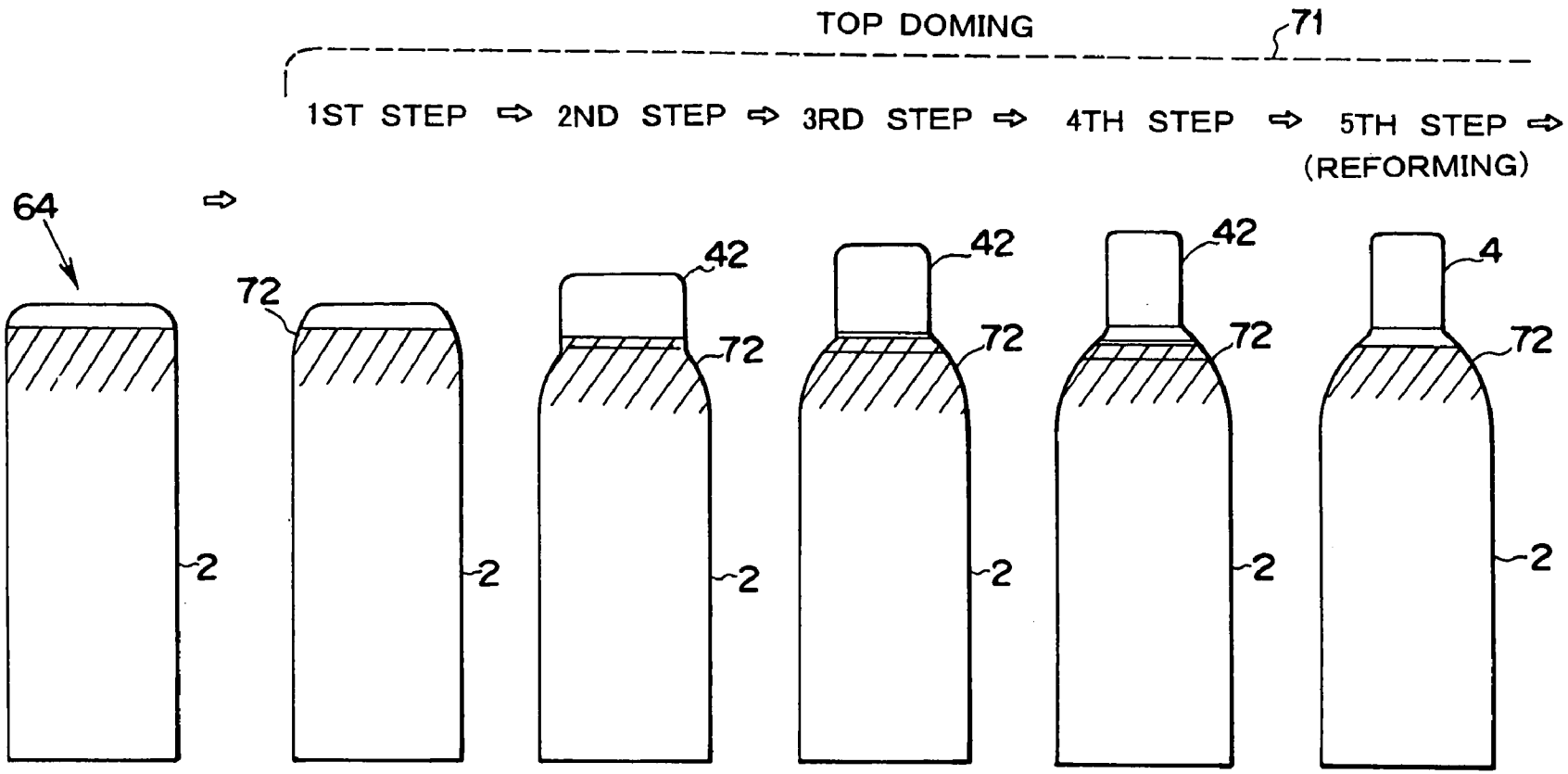
FIG. 4 presents explanatory side elevations showing the state of an area, to which printed decorations at individual steps of the top doming step of the bottle-shaped can are applied.

The long cup 64 thus printed and coated is let through the drying apparatus such as an oven kept at the high temperature, so as to dry the printed link layer and the coated layer. Then, a liquid phase lubricant, such as normal butyl stearate, fluid paraffin or synthetic paraffin is applied once again to the outer face of the trunk portion and the bottom portion of the long cup, by a lubricant applying apparatus (e.g., a waxer) such as a spray applying apparatus or an applicator, which is provided with a rotary applicator wherein its outer circumference is made of felt. In this state, at the top doming step 71, the bottom corner portion (i.e., the outer circumference of the bottom portion and the trunk portion near the bottom portion) of the long cup 64 including a portion of the printed area (i.e., the portion below the hatched portion) of the trunk portion 2, is preliminarily shaped into the curved shoulder face 72 whose longitudinal section is arcuate, as shown in FIG. 4.

Figure 3:
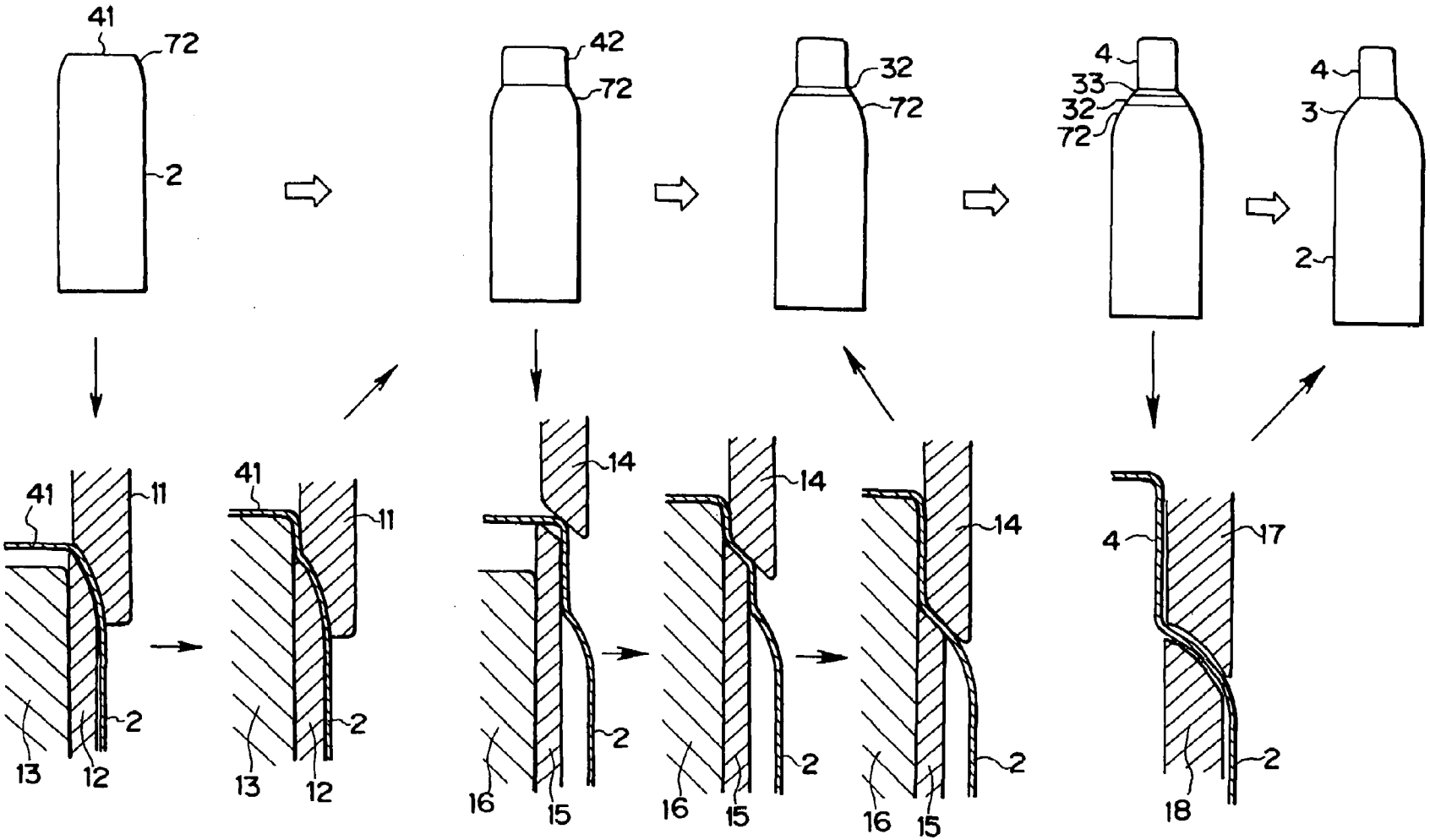
FIG. 3 presents explanatory diagrams showing the state, in which an (unopened) neck portion and a shoulder portion are formed on the bottom side of a long cup at a top doming step of the bottle-shaped can manufacturing method.

Then, the long cup 64 is positioned to have its bottom side upward, as shown in FIG. 3. The curved shoulder face 72 is unwrinkled by an unwrinkling tool (i.e., a die 11 and a pusher 12), whose curvature is congruent with the preliminarily shaped curved shoulder face 72. At the same time, a flat portion 41 surrounded by the curved shoulder face 72 is drawn by a punch 13 into a bottomed cylindrical shape having a smaller diameter than that of the trunk portion 2. After this, a bottom side of newly shaped bottomed cylindrical portion 42 is further drawn into a diametrically smaller bottomed cylindrical shape by a punch 16, in combination with unwrinkling tools (i.e., a die 14 and a pusher 15) having a tapered face whose inclination corresponds to the inclination of the curved shoulder face 72 with respect to the circumferential wall of the neck portion 4.

In the embodiment illustrated in FIGS. 2 and 3, the preliminary shaping of the curved shoulder portion 72 is carried out at the step before the drawing step using the punch 13. However, as a matter of fact, the preliminary shaping may also be carried out in the following manner.

Specifically, when the first drawing using the punch 13 is carried out, the bottom corner portion of the long cup 64 is shaped into the curved shoulder face 72, by the unwrinkling tools (i.e., the die 11 and the pusher 12) whose curvature is congruent with the curved shoulder face 72. At the same time, the flat portion 41 is drawn into the bottomed cylindrical shape by the punch 13, while the bottom corner portion being held by those unwrinkling tools (i.e., the die 11 and the pusher 12). As a result of thus using a single apparatus comprising the unwrinkling tools (i.e., the die 11 and the pusher 12) whose curvature is congruent with the curved shoulder face 72 and the punch 13, and carrying out both the shaping of the curved shoulder face 72 and the drawing of the flat portion 41 at a singular step, the wrinkling percentage of the shoulder portion can be reduced, the length of the manufacturing line can be shortened, and the facilities can be downsized.

Next, one or more times of the step of drawing (or re-drawing) is applied to the bottom side of the diametrically-small bottomed cylindrical portion 42. Working faces of the die and the pusher to be used and contacted with the long cup are tapered and flat. By this drawing (or re-drawing) treatment, the diameter of the bottomed cylindrical portion 42 is reduced to substantially equal to that of the neck portion 4 of the finished bottle-shaped can. As a result of repetition of such drawing treatment, there is formed a plurality of taper faces 32 and 33 leading from the previously formed curved shoulder portion 72. Then, those taper faces 32 and 33 are pushed and stretched. This is a step of reshaping (or reforming) the taper faces into the continuous and smooth curved face (or the domed faces). Therefore, a pair of shaping tools (i.e., a die 17 and a pusher 18), in which the curvature of its working faces are congruent with the curvature of the final shape of the curved shoulder portion, are used at this step. After this, although not specifically illustrated in FIG. 3, a mouth drawing is applied twice to the neck portion 4 formed into the bottomed cylindrical shape. The first mouth drawing step draws only an upper half of the neck portion 4, and the second mouth drawing step draws only the upper half of the portion previously drawn at the first mouth drawing step.

Prior to a threading/curling step 75, the lubricant reapplied by the aforementioned lubricant coating apparatus (i.e., a waxer) is volatilized to be removed by heating the can body to a high temperature.

Preferably, the thermoplastic resin films coating both faces of the can body are in the amorphous state at the heating time so as to improve the adhesiveness to contact with the aluminum alloy sheet of the can body. Specifically, those mixed thermoplastic resin films containing e.g., the polybutylene terephthalate resin and the polyethylene terephthalate resin, can be brought into amorphous state by heating the can body to the temperature higher than the melting point of the mixed resin films, and then quenching those films.

In case the resin films coating both faces of the can body are a thermosetting resin, it is sufficient to heat the can body to a temperature in which the lubricant is volatilized to be removed.

The reason to put the thermoplastic resin film layers into amorphous state will be explained in the following. The thermoplastic resin coating films are initially formed on the metal sheet material in the amorphous state. The thermoplastic resin coating films are then crystallized as they are stretched by the subsequent shaping treatments of the metal sheet. In this state, the thermoplastic resin coating layers may be peeled or broken as a result of applying a severe treatment at the threading/curling step 75. For this reason, the thermoplastic resin coating layers are brought into amorphous state again before carrying out the threading/curling step 75, so as to reinforce the contact with the aluminum alloy sheet.

This amorphous treatment prior to the threading/curling step 75 may also be performed by an independent heating/quenching apparatus. However, it is better to put the thermoplastic resin coating layers into amorphous state simultaneously when the lubricant is volatilized by heating the can body to the high temperature at the lubricant removing step 74 just before the threading/curling step 75. Because, in comparison with the case of using the independent heating apparatus for putting the thermoplastic resin coating layers into amorphous state, it is possible to go down the manufacturing cost of the entire can body heating apparatus. Also, it is possible to downsize the entire can body manufacturing line. Moreover, it is possible reduce the consumption energy, therefore, it is more efficient.

At the threading/curling step 75, first of all, the diametrically small portion (i.e., the portion shaped by the second mouth drawing treatment) of the unopened neck portion 4 is trimmed and opened at its upper end. Although not illustrated, the open edge is preliminary curled slightly outward. Then, a mold having a curved working face whose longitudinal section is arcuate is inserted into the upper end circumferential edge of the neck portion 4, and the preliminary curled open edge is pushed downwardly by the curling punch. As a result, the externally curled portion 4*a* is shaped on the upper end open edge of the neck portion 4. Subsequently, the lower inclined wall is shaped into a curved face of a bulging arcuate shape.

Next, the threaded portion 4*b* is formed on the cylindrical circumferential wall located at a position lower than the inclined wall below the curled portion 4*a* by a suitable method, such as, by inserting a female mold into the neck portion 4 and pressing the cylindrical circumferential wall by a roll from outer side, or by pressing the cylindrical circumferential wall by a roll from inner side of the neck portion 4. Moreover, the annular recess 4*d* is formed below and at a predetermined distance from the threaded portion 4*b* by pressing by the roll from the outer side. As a result, the annular beaded portion 4*c* is formed between the annular recess 4*d* and the threaded portion 4*b*.

At the necking-in/flanging step 76, the necking-in and the flanging are applied sequentially to the open end portion 77 at lower end of the trunk portion on the opposite side of the neck portion 4. Then, at the bottom lid seaming step, a separate bottom lid is attached to the flanged portion formed at the open lower end of the can body by the double seaming method using the seamer (i.e., the can lid seaming machine). As a result, the bottle-shaped can capable of containing the content is completed.

This bottom lid to be used is made of e.g., an aluminum alloy (5182-H39), in which the mixed resin film containing the polybutylene terephthalate resin and the polyethylene terephthalate rein a thickness thereof is 0.02 mm, is thermally fused on its both faces. A thickness of the bottom lid is 0.285 mm, and a diameter is 62.6 mm. Here, the necking-in/flanging step, and the bottom lid seaming step can be carried out continuously by a single combination machine.

As illustrated in FIG. 4, according to the method of the invention thus far described, the outer face of long cup 64 is printed and coated at the aforementioned printing/coating step up to the portion near the bottom portion of its cylindrical trunk portion 2. This particular portion is hatched in the Figures, and it is to be shaped into the shoulder portion 3 at the subsequent steps. Therefore, the printed decoration on the trunk portion 2 of the long cup 64 extends not only within the trunk portion 2 but also to the shoulder portion 3 of the can body, after the neck portion 4 and the shoulder portion 3 are shaped thereon at the subsequent step.

With respect to the vertical direction of the printed decoration applied to the trunk portion 2 of the long cup 64, the printed decoration is directed to the bottom side of the long cup 64, in other words, to the neck portion 4 side of the can body.

The portion near the bottom portion of the trunk portion 2 of the long cup 64 (i.e., the portion to be formed into the shoulder portion) is reshaped into the shoulder portion 3 at the subsequent steps. Specifically, the preliminary shaped curved shoulder face 72 is reshaped into a portion of the diametrically small bottomed cylindrical portion, and the lower portion of the trunk portion is reshaped into the curved shoulder face 72.

Figure 7A:
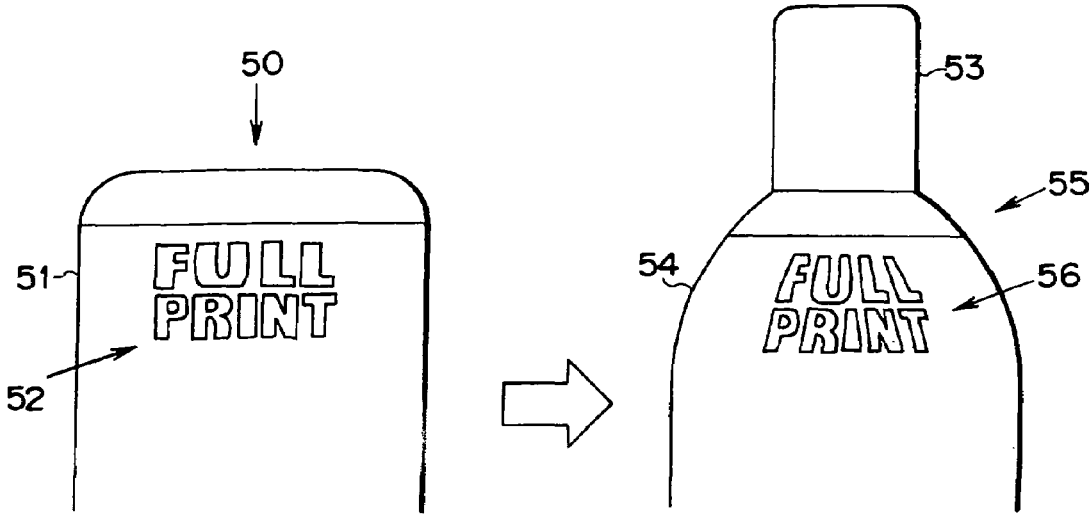
FIG.7A PRIOR ART
FIG. 7A is a side elevation showing examples of the printed decoration, which has been applied to a portion (to be shaped into the shoulder portion) near the bottom portion of the can trunk of the long cup, and the printed decoration, which has been changed by shaping the shoulder portion, in accordance with the method of the prior art.
Figure 7B:
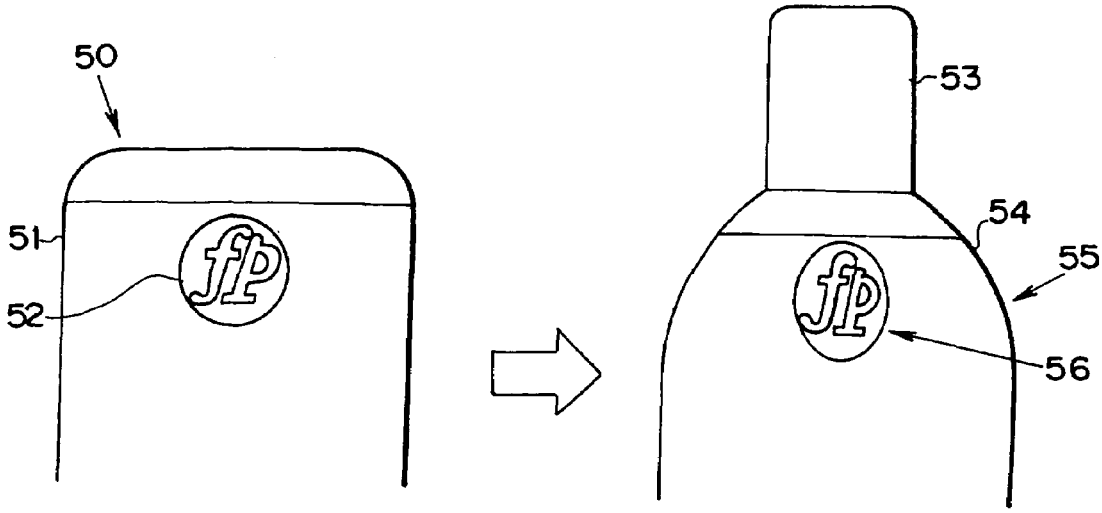
FIG.7B PRIOR ART
FIG. 7B is a side elevation showing other examples of the printed decoration, which has been applied to a portion (to be shaped into the shoulder portion) near the bottom portion of the can trunk of the long cup, and the printed decoration, which has been changed by shaping the shoulder portion, in accordance with the method of the prior art.

At the occasion of reshaping, the diameter of the long cup is reduced significantly as getting closer to the bottom portion. This means the circumferential length gets also smaller as getting closer to the bottom portion. Therefore, as illustrated in the left side of FIGS. 7A and 7B for example, if letters or a pattern of a printed decoration 52 is printed on near the bottom of a trunk portion 51 of a long cup 50 in a desired (or normal) shape for the product, as the case of prior art, the letters or a pattern printed on the shoulder portion is shrunk and gets narrower as it goes upward in consequence of reshaping of the shoulder portion, as shown in the right sides of FIGS. 7A and 7B.

Therefore, in case of printing the printed decoration not only on the trunk portion of the can body but also on the shoulder portion, it is necessary to take into consideration the shrinkage of the printed decoration to be printed on the portion near the bottom of the trunk portion of the long cup (i.e., on the portion to be reshaped into the shoulder portion) due to execution of subsequent treatments. The shrinkage is especially serious at a portion of the shoulder portion distant from the trunk portion.

As a result, in case of commercializing the can body (or the bottle-shaped can) in which the decoration is printed to the shoulder portion by the prior art, the printed decoration applied to the shoulder portion of the can body has to be limited to a simple pattern in which the shrinkage is inconspicuous, for example, floating clouds in the blue sky, a monotone background, a simple density pattern, or a simple geometric pattern.

On the other hand, according to the method of the invention, the printed decoration 68 of determinate letters or design is printed on the portion near the bottom portion of the cylindrical trunk portion 2 of the long cup 64 (i.e., the portion to be shaped into the shoulder portion 3). As shown in the left sides of FIGS. 5A and 5B, the width of the letters or pattern of the printed decoration 68 applied to the portion to be shaped into the shoulder portion 3 becomes wider as it goes upward of the desired shape (i.e., with respect to the vertical direction of the printed decoration). For this reason, the printed decoration 68 is shaped into the desired shape due to the shrinkage of the letters or pattern in the upward direction resulting from the reshaping of the portion near the bottom portion of the trunk portion 2 of the long cup 64 into the sloped shoulder portion 3, as shown on the right sides of FIGS. 5A and 5B.

In case the letters or pattern is printed over the trunk portion and the shoulder portion of the can body, the entire printed decoration is apparently distorted if only a portion of the printed decoration (i.e., at the shoulder portion) is tapered. Although not especially shown, in order to avoid such disadvantage, only the portion of letters or pattern on the outer face of the trunk portion 2 of the long cup, which is to be formed into the shoulder portion, is distorted in advance. As a result of this, the letters or pattern can be printed normally over the trunk portion and the shoulder portion without being distorted.

The embodiment thus far described is a first specific embodiment of the method of the invention for manufacturing the can body of the bottle-shaped can, in which the printed decoration is applied to the shoulder portion.

Next, here will be briefly described a second specific embodiment of the invention for manufacturing a can body of an aerosol can by a shaping method similar to the aforementioned method for manufacturing the bottle-shaped can.

The material to be shaped into the long cup may be any of an aluminum sheet, an aluminum alloy sheet and a surface-treated steel sheet. Moreover, both kinds of metal sheet, in which both faces are coated with a thermoplastic resin layer in advance, and which is not covered with the resin film, may be used as a material.

In case the long cup is not shaped from the metal sheet material in which both faces are coated with the resin film, it is preferable to use the surface-treated steel sheet, e.g., the tin-plated steel sheet or the zinc-plated steel sheet, in which lubricant tin or zinc are plated on the steel sheet surfaces, in the light of the formability. Here, the electrolytic chromate-treated steel sheet is inferior in the ironing workability.

First, in order to form the domed shoulder portion and the diametrically small bottomed cylindrical portion, plural times of drawing and reshaping (or reforming) is applied to the bottom side of the long cup. Then, a leading end of the bottomed cylindrical portion is opened, and the open end portion is curled to form a curled portion. On the other hand, the necking-in and the flanging are applied to the end portion of the trunk portion on the opposite side of the curled portion, and the bottom lid is attached thereto by the seaming method. Hereinafter, one example of a manufacturing process of the aerosol can will be described with reference to FIG. 6.

At Step (a), first of all, a disc sheet 100 for making one can is punched out from the metal sheet material, in which both faces are coated with a polyester resin film, and in which a high-temperature volatile lubricant is further applied to both faces. Next, at Step (b), the disc sheet 100 is drawn into a shallow cup 101. At Step (c) the shallow cup 101 is re-drawn to reduce the diameter and to increase the height, so as to be shaped into a middle height cup 101A. At Step (d), the re-drawing and stretching are further applied to the cup 101A, so as to further reduce the diameter and thickness of the trunk portion thereby increasing its height. At Step (e), the ironing is applied to reduce the thickness and increase the height. At Step (f), the ironing is applied once again to further reduce the thickness of the trunk portion and to increase the height. As a result, there is formed a flanged long cup (or a long cup) 102.

In this example, from the step of re-drawing the shallow cup 101, through the step of simultaneous re-drawing and stretching, to the subsequent two steps of ironing, those steps are carried out with the flanged portion 103 remaining at the open end.

Additionally, a shallow recess 104 is formed in the bottom portion when carrying out the second ironing.

Then, at Step (g), the long cup 102 is heated to a high temperature (this heating step is not shown) to volatilize and remove the lubricant from at least the outer face side of the long cup 102, and the open end portion is trimmed to make the height even.

Subsequently, at Step (h), the outer face of the trunk portion of the long cup 102 is printed in multiple colors substantially all over the surface by the well-known dry offset printing method. Immediately, a clear coating is applied to the printed face, and the printing ink and the clear coating film are dried by passing the long cup through a heating apparatus such as an oven. Here, the area, to which the printed decoration is applied at Step (h), is the area between horizontal lines L1 and L2 drawn near the open end and the bottom portion.

The width of the letters or pattern of the decoration, which is/are printed at this printing step, on the outer face of the long cup 102 and at the portion to be shaped into the shoulder portion at the subsequent step, becomes wider as it goes closer to the bottom side.

Figure 6:
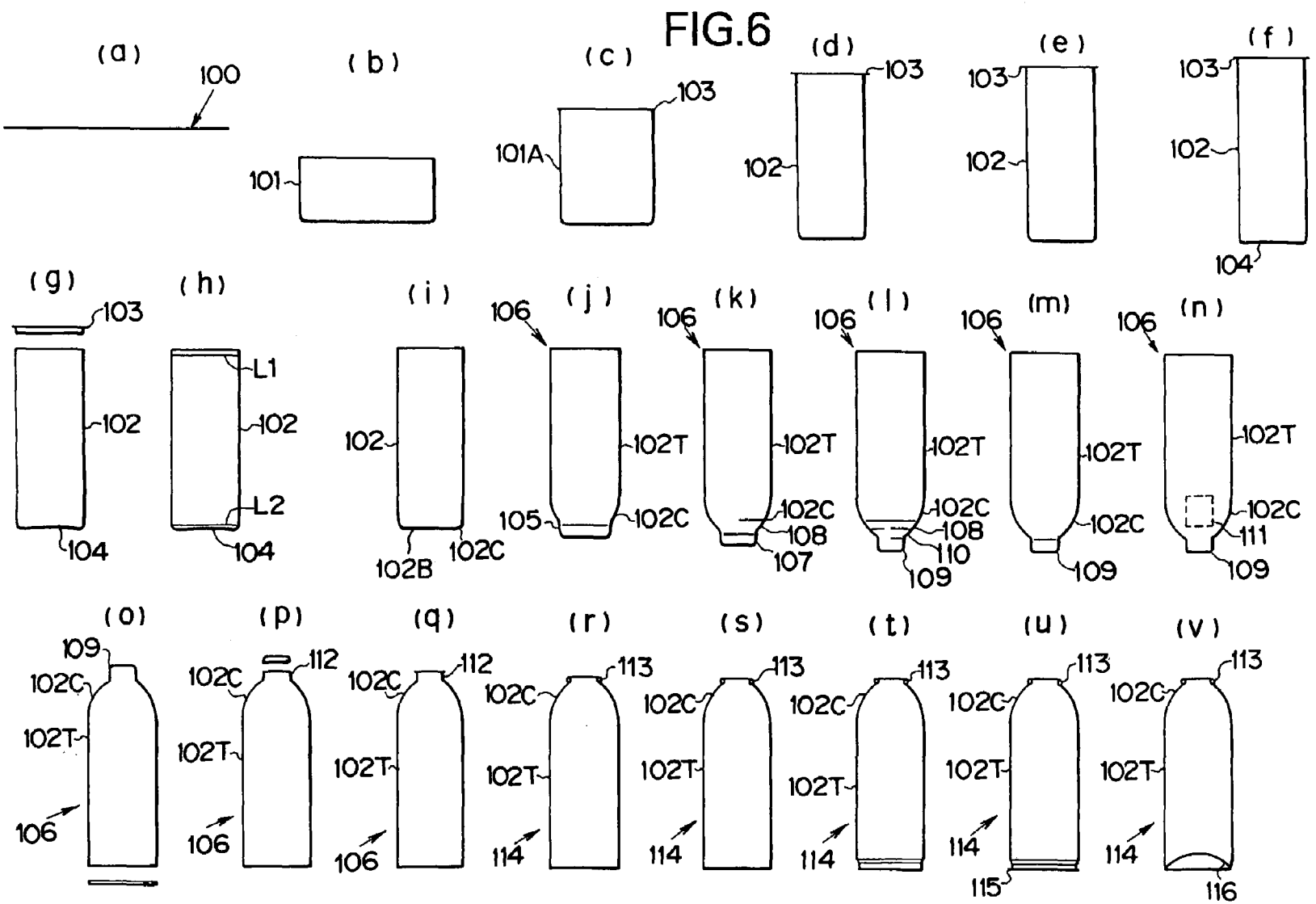
FIG. 6 presents schematic step diagrams for explaining a process for manufacturing an aerosol can by the method of the invention.

Next, although not shown in FIG. 6, a high-temperature volatile lubricant is applied to the outer face of the trunk portion and the bottom portion of the printed long cup 102. Then, at Step (i), the bottom corner portion (i.e., the bottom portion and the trunk portion near the former) of the long cup 102 are preliminarily shaped into a curved shoulder face 102C whose longitudinal section is arcuate. This shaping treatment is carried out by inserting a punch having a curved outer circumferential face at its leading end into the long cup, and by pushing the punch against a bottom mold having a recessed inner face corresponding to the curved face of the punch (both the punch and the mold are not shown). Subsequently, at Step (j), a bottom portion 102B enclosed by the bottom corner portion of the long cup 102 is drawn into a bottomed cylindrical shape, as in the example illustrated in FIG. 3. For this purpose, there is used an apparatus comprising an unwrinkling tools (i.e., tools like the die 11 and the pusher 12 illustrated in FIG. 3) and a punch (similar to the punch 13 shown in FIG. 3). The curvatures of working faces of the unwrinkling tools positioned at leading ends of those tools are congruent with the curvature of the curved shoulder face 102C. As a result, there is formed a long cup 106 comprising: a bottomed cylindrical portion 105, which is diametrically smaller than a trunk portion 102T; and the curved shoulder face 102C merging into the lower end of the bottomed cylindrical portion 105.

As shown in FIG. 6, at Step (k), there is formed a diametrically smaller bottomed cylindrical portion 107 and a sloped face 108 merging into the curved shoulder face 102C. Those diametrically smaller bottomed cylindrical portion 107 and sloped face 108 are formed by inserting the punch into the bottomed cylindrical portion 105, while unwrinkling the bottom corner portion of the bottomed cylindrical portion 105 using the unwrinkling tools (similar to the die 14 and the pusher 15 shown in FIG. 3), and by moving the punch and the unwrinkling tools relatively to come close to each other. As the die 14 and the pusher 15, the inclination of the tapered working face of the unwrinkling tools are congruent with the inclination of the curved shoulder face 102C with respect to the circumferential wall of the diametrically smaller bottomed cylindrical portion 107.

Then, at Step (1), there is formed a diametrically smaller bottomed cylindrical portion 109 and a sloped face 110 leading thereto, as in the example illustrated in FIG. 3. Those diametrically smaller bottomed cylindrical portion 109 and sloped face 110 are formed by repeating the procedure of step (k) once again, specifically, by inserting a punch 16 into the newly formed diametrically smaller bottomed cylindrical portion 107, while unwrinkling the bottom corner portion of the diametrically smaller bottomed cylindrical portion 107 using a pair of unwrinkling tools (similar to the die 14 and the pusher 15 shown in FIG. 3), and by moving the punch and the unwrinkling tools relatively to come close to each other. As explained in the above paragraph, the inclination of the tapered working face of the unwrinkling tools are congruent with the inclination of the curved shoulder face 102C with respect to the circumferential wall of the diametrically smaller bottomed cylindrical portion 107.

At Step (m), the curved shoulder face 102C, the sloped face 108 and the sloped face 110, which has been shaped at Steps (j), (k), and (l) of FIG. 6, are entirety shaped into a smoothly continuous curve (or a domed curve). For this purpose, as in the example illustrated in FIG. 3, a pair of reshaping tools (similar to the die 17 and the pusher 18 shown in FIG. 3), in which the curvature of its working faces are congruent with the curvature of the final shape of the curved shoulder face 102C, are used to push (or press) and extend (or stretch) a portion of the curved shoulder face 102C, the sloped face 108 and the sloped face 110. At Step (n), in order to sharpen the merging portion between the diametrically smaller bottomed cylindrical portion 109 and the shoulder portion, that is, in order to reshape the diametrically smaller bottomed cylindrical portion 109 into vertical shape from the upper end to the lower end, the cylindrical shape of the merging portion between the diametrically smaller cylindrical portion and the shoulder portion is pressed and extended, by a pair of reshaping tools having appropriate shapes for that purpose at their leading end portions. As a result, the merging portion between the diametrically smaller cylindrical portion and the shoulder portion is reshaped into the desired shape.

Moreover, a width of a pattern or letters of a printed decoration 111 applied to the shoulder portion becomes wider as it gets closer to the upper end side of the shoulder portion, when it is printed. Therefore, as a result of the diametrical shrinkage due to the shaping of the shoulder portion, which becomes more significant toward the upper end side, the pattern and letters printed on the shoulder portion is changed to proper widths and lengths.

Then, at Step (o), the long cup 106 is trimmed on its open end side to an even height; at Step (p), the diametrically smaller bottomed cylindrical portion 109 is trimmed and opened; at Step (q), a diametrically small cylindrical portion 112 thus opened is slightly bent outward at its leading end (i.e., a pre-curl step); and, a curled portion 113 is formed at Steps (r) and (s) (i.e., a die-curling step and a roll-curling step).

At Step (t), a necking-in treatment is applied to the open end of the trunk portion of an aerosol can 114 on which the curled portion 113 is formed. Then, at Step (u), the leading end portion to which the necking-in has been applied is flanged to form a flanged portion 115. Subsequently, at Step (v), a bottom lid 116 is seamed with the flanged portion 115 of the aerosol can 114. As a result, there is completed the aerosol can 114, in which one of the end portions is opened, and in which the decorative pattern and/or letters is/are printed on the trunk portion and shoulder portion in a desired shape.

In the examples of the bottle-shaped can and the aerosol can thus far described, the shoulder portion is formed into the dome shape. According to the invention, however, the shape of the shoulder portion should not be limited thereto but may also be exemplified by a frusto-conical shape.

The method for shaping a bottle-shaped can having a shoulder portion in the frusto-conical shape is disclosed in detail in U.S. Pat. No. 6,499,329, and the disclosed method can also be used in the present invention. Therefore, a description thereof is omitted.

Both of the foregoing examples thus have been described are the examples of the method for manufacturing the can body, in which the bottom side of the long cup is shaped into the sloped shoulder portion and the diametrically small bottomed cylindrical portion. Next, here will be described a third specific example of the invention. This third example is a method for shaping the sloped shoulder portion and the diametrically small cylindrical portion by necking the open end side of the long cup.

The steps of the method for manufacturing the can body of this type are identical to those of the foregoing two embodiments up to the steps of shaping the long cup and removing the lubricant from the surface of the long cup, therefore, the descriptions of the common steps are omitted. Additionally, in the third embodiment, the number of the steps of necking the open side of the long cup is approximately ten to twenty or more, however, the shape changes little by little. Therefore, the flow chart showing those steps is omitted so as to restrain the number of figures.

First of all, the long cup is shaped from the metal sheet, in which both faces are covered with a thermoplastic resin film, and the lubricant is further applied thereto. Next, the lubricant is removed from the outer face of the long cup. Then, a decoration is printed on the outer face of the trunk portion of this cup by the well-known dry offset printing method, and the printed face is immediately coated with a clear coating. Subsequently, the long cup is transferred through a heated oven to dry the printing ink and the coating film.

Here, the width of the pattern or letters printed at this printing step, on the portion to be shaped into the shoulder portion by the necking of a later step, becomes wider as it goes closer to the open end.

Then, a lubricant is applied to at least a portion of the printed outer face of the trunk portion of the long cup which is to be shaped into the shoulder portion. The lubricant may also be applied all over the outer face of the trunk portion of the long cup.

Then, the necking is applied from the open end side of the long cup repeatedly, by using, e.g., the neck-in die the shape of which is illustrated in FIGS. 4 to 13 of the aforementioned U.S. Pat. No. 5,355,710. Although the number of application of the necking is different according to the size difference between the external diameters of the trunk portion of the long cup and the neck portion to be shaped, the necking is carried out ten to twenty times or more.

As illustrated in FIGS. 2 and 3 of the aforementioned U.S. Pat. No. 5,355,710, there is formed the shoulder portion, which is sloped smoothly from the cylindrical trunk portion toward the axis of the trunk portion and toward the open portion, as a result of the repetition of this necking treatment. Moreover, a diametrically small cylindrical neck portion is shaped in the vicinity of the open portion.

In this third example, the width of the pattern or letters of the decoration printed on the outer face of the trunk portion of the cylindrical long cup also becomes wider as it goes closer to the open end side only at the portion to be shaped into the shoulder portion. Therefore, the pattern or the letters of the decoration is printed normally on the shoulder portion with the normal width. This improves the beauty of the printed decoration entirely.

Next, the diametrically small cylindrical portion of the long cup is trimmed at its leading end portion to make the height even by a not-shown trimming tool. Then, the diametrically small cylindrical portion is threaded by a not shown pair of threading tools. Below the threaded portion, an annular ridge for fixing the Pilfer proof band is formed by a not shown pair of rolling tools. After this, the leading end of diametrically small cylindrical portion is bent outwardly by not shown plural curling tools to form a curled portion. As a result, there is completed the bottle-shaped can: in which the decorative print is printed on its trunk portion and sloped shoulder portion normally; and in which the bottom portion, the trunk portion, the shoulder portion and the threaded neck portion are shaped integrally.

Here, the third example can also be applied to the bottle-shaped can, in which a curled portion is simply formed at its leading end portion after trimming the leading end portion of the diametrically small cylindrical portion of the long cup.

A cap to be mounted and fixed on the neck portion of the bottle-shaped can is exemplified by an easily openable cap made of an aluminum alloy sheet, comprising: a top plate; a skirt portion depending from around the top plate; a tab extending from the skirt portion to be pinched by fingers; and a seal member placed on the inner face side at around a boundary between the top plate and the skirt portion. Additionally, this cap has a score line extending from the end portion of the tab to the top plate through the skirt portion. Here, this kind of cap is disclosed in U.S. Pat. Nos. 4,256,233 and 4,098,420. The bottle-shaped can is sealed by mounting the cap on the neck portion, and then bending the skirt portion inwardly along the lower face of the curled portion by a not shown capper (or crimper).

Next, here will be briefly described a fourth specific example of the invention. The fourth example is a method for manufacturing an aerosol can, in which the bottom portion, the trunk portion, the sloped shoulder portion and the open portion are formed integrally, and in which the printed decoration is normally printed on the trunk portion and the shoulder portion.

The aerosol can manufacturing method according to the fourth example can be executed substantially in the same manner as the aforementioned bottle-shaped can manufacturing method of the third specific example.

The threaded portion and the annular ridge are unnecessary for the aerosol can, therefore, the length of the diametrically small cylindrical portion can be short (although the length for shaping the curled portion is needed). For this reason, the steps of shaping the threaded portion and the annular ridge are eliminated from the fourth example. This is the most obvious difference in comparison with the third example.

The steps of the method are absolutely identical to those of the third embodiment up to the steps of shaping the long cup and removing the lubricant from the surface of the long cup.

Also, the printing/coating step, the necking step of the open side, and the trimming step of the open end portion are identical to those of the third embodiment. Subsequent to these steps, the step of bending the open end portion outwardly is carried out to form the curled portion. As a result, there is completed the aerosol can: in which the pattern or letters is printed on its trunk portion and shoulder portion normally; and in which the bottom portion, the trunk portion, the sloped shoulder portion and the open portion having the curled portion are shaped integrally.

What is claimed is:

1. A can body manufacturing method in which a bottomed cylindrical long cup whose trunk portion is thinned by drawing and ironing a metal sheet, in which a printed decoration is then applied to the outer face of a cylindrical trunk portion of the long cup, and in which one of the end sides of the long cup is then shaped into a sloped shoulder portion which is diametrically reduced toward a leading end side wherein the printed decoration is printed on the outer face of the cylindrical trunk portion of the long cup to the portion to be shaped into the shoulder portion at a subsequent treatment and wherein the pattern or letter of the printed decoration applied to the portion to be shaped into the shoulder portion is distorted to be wider in upward direction, in comparison with a final desired figure, wherein the printed decoration is printed using a printing plate prepared by:

printing a lattice pattern, which is formed by a plurality of transverse lines extending horizontally at an equal interval and a plurality of longitudinal lines extending vertically to those transverse lines at an equal interval, and which has a series of quadrangles defined by two circumferential lines and two vertical lines, on the outer face of the trunk portion of the long cup;

applying a protective coating to the lattice pattern, and then drying the printed lattice pattern and the protective coating;

forming an inclined shoulder portion by drawing one of the end side of the long cup, and then reshaping the inclined shoulder portion into a smoothly curved shoulder portion;

measuring lengths of two horizontal sides and two vertical sides of a plurality of quadrangles defined by common two circumferential lines on the trunk portion at different horizontal position;

measuring lengths of two horizontal sides and two vertical sides of a plurality of quadrangles defined by common two circumferential lines on the shaped shoulder portion at different horizontal position, whereas the vertical sides are measured from a position substantially perpendicular to the inclination of the shoulder portion, and whereas the measurement is carried out sequentially upwardly on the shoulder portion;

calculating changing amounts of the lengths of the vertical sides and the horizontal sides of each measured quadrangles by comparing measured values and the length of the individual sides before the shoulder portion is shaped, while calculating an average value on the common circumference;

calculating a decreasing rate or an increasing rate in the transverse length and the longitudinal length of the portion deformed as a result of being formed into the shoulder portion, by the following formula: $B=\alpha A$, where A represents an original length when printed; B represents a changed length; and $\alpha$ represents a changing rate;

calculating a correction value using the obtained decreasing rate or an increasing rate by the following formula: correction value $=1/\alpha$; and increasing the width and the length of a portion of a pattern of the printing plate which is to be printed on the portion to be formed into the shoulder portion by the correction value in case that those dimensions will be decreased as a result of shaping the shoulder portion, and decreasing the width and the length of a portion of a pattern of the printing plate which is to be printed on the portion to be formed into the shoulder portion by the correction value in case that those dimensions will be increased as a result of shaping the shoulder portion.

2. The can body manufacturing method according to claim 1:

wherein said can body is a bottle-shaped can, in which a neck portion and the shoulder portion are integrally formed on the bottom side of the long cup, and a bottom lid is attached to an opening lower end of the trunk portion; and wherein the upper portion of the printed decoration is directed to the bottom side of the long cup.

3. The can body manufacturing method according to claim 1:

wherein said can body is an aerosol can, in which an open portion and the shoulder portion are integrally formed on the bottom side of the long cup, and a bottom lid is attached to an opening lower end of the trunk portion; and wherein the upper portion of the printed decoration is directed to the bottom side of the long cup.

4. The can body manufacturing method according to claim 1:

wherein said can body is a bottle-shaped can, in which a neck portion and the shoulder portion are integrally formed on the open end side of the long cup, and the trunk portion and a bottom portion are integrally formed; and wherein the upper portion of the printed decoration is directed to the open end side of the long cup.

5. The can body manufacturing method according to claim 1:

wherein said can body is an aerosol can, in which an open portion and the shoulder portion are integrally formed on the open end side of the long cup, and the trunk portion and a bottom portion are integrally formed; and wherein the upper portion of the printed decoration is directed to the open end side of the long cup.

* * * * *